United States Patent [19]

Brown et al.

[11] Patent Number: 4,735,162

[45] Date of Patent: Apr. 5, 1988

[54] DEVICE FOR INDICATING BY ILLUMINATION THE SELECTED STITCH PATTERN ON A SEWING MACHINE

[75] Inventors: John Brown, Wilton, Conn.; John Blackwood, Union, N.J.

[73] Assignee: SSMC Inc., Shelton, Conn.

[21] Appl. No.: 90,172

[22] Filed: Aug. 27, 1987

[51] Int. Cl.[4] ..... D05B 3/02; D05B 79/00

[52] U.S. Cl. ..... 112/444; 362/29; 112/445

[58] Field of Search ..... 112/445, 444, 453, 121.11, 112/121.12, 272, 273, 278; 358/901; 362/29, 31

[56] References Cited

U.S. PATENT DOCUMENTS 3,918,392 11/1975 Gibson et al. ..... 358/901 X
4,170,950 10/1979 Ozaki ..... 112/444
4,553,491 11/1985 Brauch et al. ..... 112/465
4,696,246 9/1987 Rohr et al. ..... 112/272

FOREIGN PATENT DOCUMENTS 0970759 12/1972 Italy ..... 112/444
0689673 2/1973 Japan ..... 112/453

*Primary Examiner*—Peter Nerbun
*Attorney, Agent, or Firm*—Robert E. Smith

[57] ABSTRACT

A flexible light pipe fixed at one extremity to admit light from the lamp illuminating the stitch forming area is shiftably supported at the other extremity to illuminate representation of the selected stitch pattern, and an expandable coil in the light pipe is constrained within a mechanism free compartment within the sewing machine.

5 Claims, 2 Drawing Sheets

DEVICE FOR INDICATING BY ILLUMINATION THE SELECTED STITCH PATTERN ON A SEWING MACHINE

FIELD OF THE INVENTION

This invention relates to sewing machines having operator influenced means for selectively rendering effective any one of a plurality of different stitch patterns, and more particularly, to a novel arrangement for illuminating a representation on the sewing machine of the selected stitch pattern.

BACKGROUND OF THE INVENTION

In a sewing machine in which any one of a plurality of different stitch patterns may be rendered effective, indication to the machine operator of the selected pattern has for the most part been accomplished by a shiftable mechanical indicator such as a dial indicator or the like. Since it is additionally advantageous continuously to display representation of all of the selectable stitch patterns, prior mechanical indicators being restricted in size, provide poor indication of selected pattern particularly where the sewing machine is used in a poorly illuminated area. The present invention is particularly adapted for use on a sewing machine in which all selectable stitch patterns are represented on the sewing machine and involves a novel and significantly cost effective arrangement for indicating by illumination the representation of the selected stitch pattern.

DESCRIPTION OF THE PRIOR ART

The Japanese Utility Model Publication No. 6896, Feb. 22, 1973, discloses use of fixed light pipes with means to vary the illumination transmitted thereby so as to indicate various sewing machine manual control settings such as stitch length, width of zigzag stitching or the like. The limited variation available in the character of transmitted light by this disclosure would not make it particularly viable for indicating selected stitch pattern.

The Italian Pat. No. 970759, Dec. 28, 1972 utilizes a prism to transmit light from the lamp in the head of a sewing machine to a location adjacent representations of selectable stitch patterns where the light is selectively directed by a shiftable reflector to illuminate the representation of the selected stitch pattern. This arrangement, in addition to being expensive and bulky, restricts the location of stitch pattern representations to areas closely adjacent the sewing lamp, and may be adversely affected by deposition of dust and lint which are prevalent in any sewing environment.

SUMMARY OF THE INVENTION

It is an object of this invention to indicate the selected one of a plurality of selectable stitch patterns depicted on a sewing machine by shiftable supporting one extremity of a coiled light pipe for movement adjacent the representation of the selected stitch pattern and constraining the opposite extremity of the light pipe adjacent the lamp in the head of the sewing machine.

It is an object of this invention in a stitch pattern indicator of the character above to support the light pipe within the sewing machine so as to locate an expandable coil in the light pipe within a compartment free of moving sewing machine mechanism thus to provide wide latitude in location and dispersion of stitch pattern representations on the sewing machine without conflict between the light pipe and the sewing mechanism.

DESCRIPTION OF THE DRAWINGS

With the above and additional objects and advantages in view, as will hereinafter appear, the invention will now be described with reference to the accompanying drawings in which.

DESCRIPTION OF THE INVENTION

Figure 1:
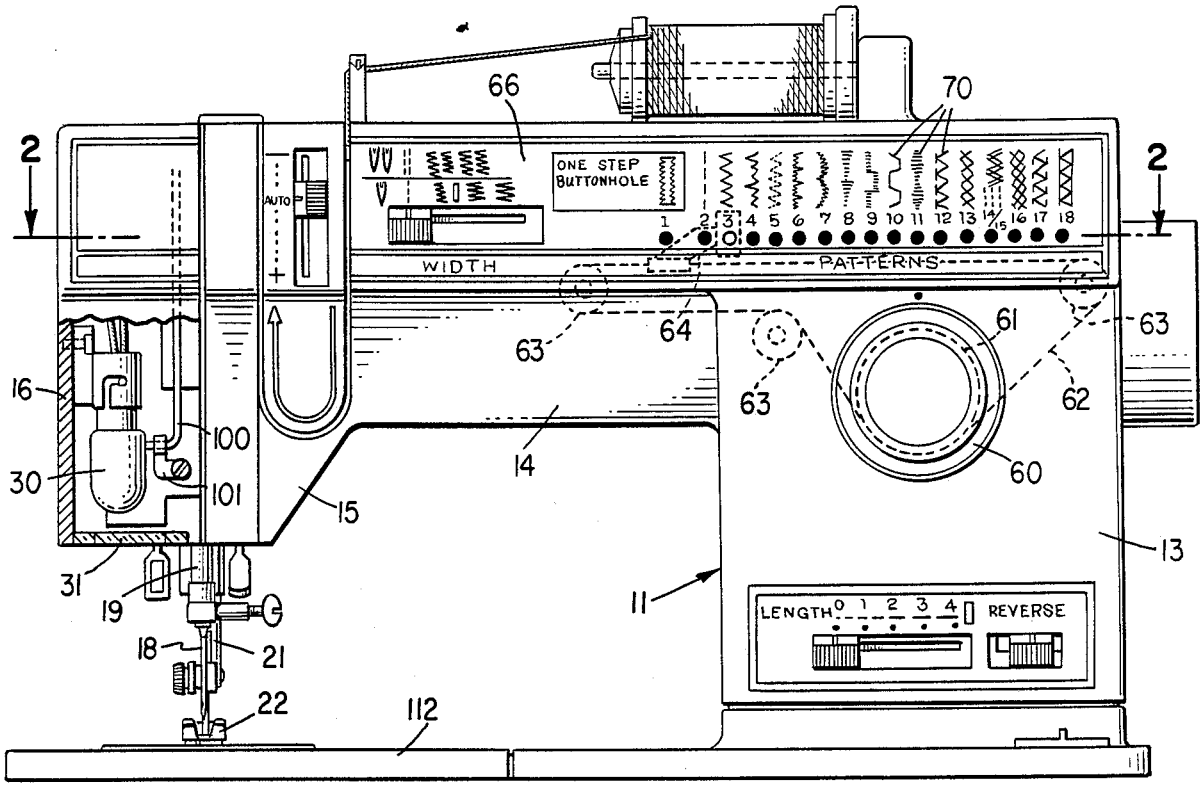
FIG. 1 is a front elevational view of a sewing machine with an operator selectable stitch patterning means to which the indicating device of this invention is applied.
Figure 2:
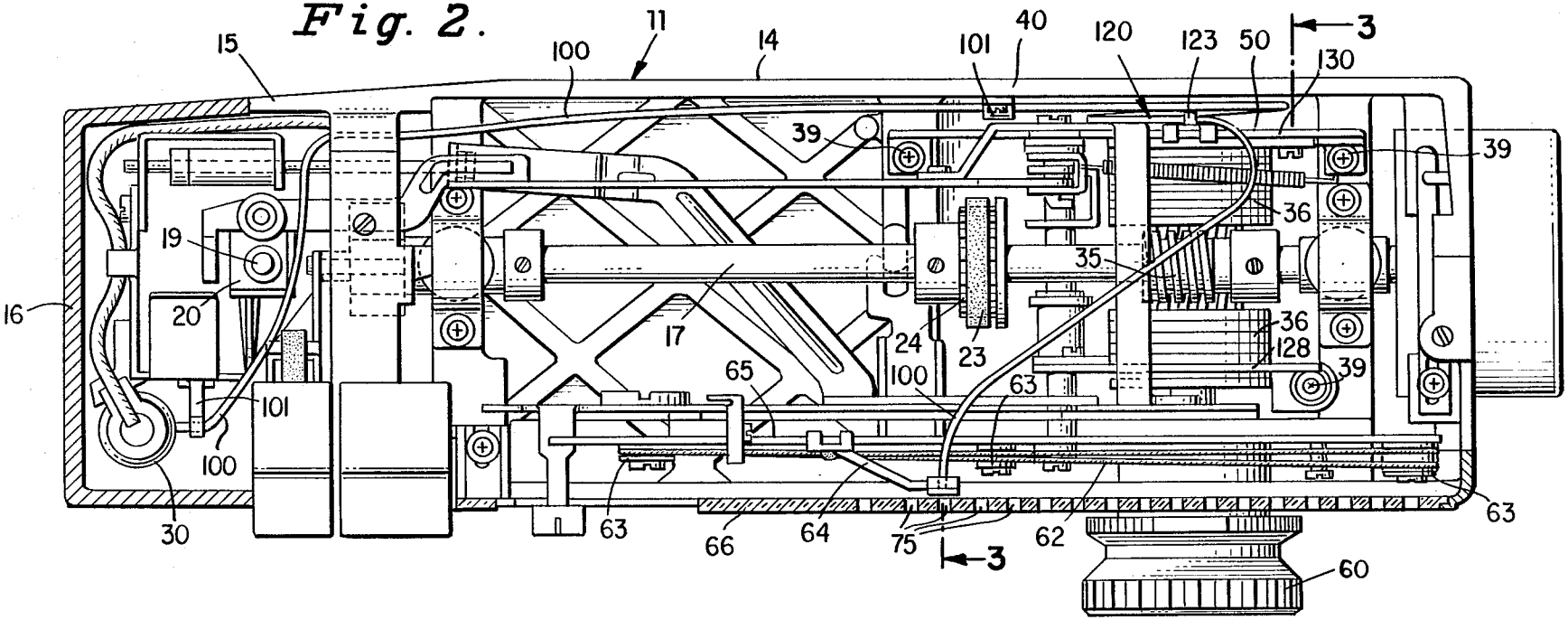
FIG. 2 is a cross sectional view of the sewing machine of FIG.1 taken substantially along line 2—2 of FIG. 1 illustrating the manner in which the light pipe is supported so as to locate an expandable coil in the light pipe within a compartment which is free of moving sewing machine mechanism.

FIGS. 1 and 2 illustrate the type of sewing machine to which the stitch pattern indicating means of this invention may advantageously be applied. Indicated generally at 11 is a hollow frame of the sewing machine which may include a work supporting bed 12, a standard 13 rising from the bed from which extends a bracket arm 14 overhanging the bed and terminating in a sewing head 15 which may be closed by a cover plate 16.

A main drive shaft 17 journaled in the bracket arm 14 imparts endwise reciprocation to a needle 18 carried by a needle bar 19 arranged in a transversely shiftable gate 20 in the sewing head. The needle carrying bar 19 is arranged adjacent a presser bar 21 to which is secured a presser foot 22 for constraining fabric against the bed 12 at a location where stitches are formed therein by the needle 18 and stitch forming mechanism (not shown) in the bed 12 which stitch forming mechanism is driven , for instance, by a belt 23 from a pulley 24 on the main drive shaft 17.

An electric lamp 30 is carried in the sewing head 15 preferrably enclosed by the cover plate 16 and arranged to provide illumination through a lens 31 to the stitch forming area on the work supporting bed.

The sewing machine main shaft 17 also drives, by way of a worm 35 on the main shaft, a stack of pattern cams 36 for imparting selective patterns of lateral jogging movements to the needle bar gate 20 and for imparting selective patterns of work feeding movements to work feeding mechanism which is part of the stitch forming mechanism (not shown) carried in the bed 12.

Although the cam stack 36, the follower arrangement for imparting cam dictated control movements to the needle bar gate and work feed mechanism, and the mechanism for selectively rendering specific pattern cams in the stack 36 effective may be of any construction known in the art, that illustrated in the accompanying drawings is preferrably constructed and arranged in accordance with that disclosed in the U.S. Pat. No. 4,553,491, Nov. 19, 1985 of Brauch et al which is incorporated herein by reference.

As described in detail in the referenced U.S. Pat. No. 4,553,491, the cam stack, cam follower system, and cam selection mechanism are arranged in a sub-assembly between front and back sheet metal plates 128 and 130.

For purposes of the present invention, the sub-assembled cam stack unit is secured within the bracket arm 14 of the sewing machine frame as by fastening screws 39 with the back sheet metal plate 130 of the cam stack sub-assembly arranged in spaced relation to the rear wall 40 of the bracket arm 14 so as to define therebetween a compartment 50 free of any operative moving mechanism of the sewing machine.

An operator influenced pattern selecting knob 60 which extends from the cam stack sub-assembly and protrudes forwardly of the standard 13 is arranged to selectively render effective specific pattern cams in the stack in accordance with the U.S. Pat. No. 4,553,491. The knob 60 is also fitted with a drive pulley 61 engaged by an endless belt 62 which is directed over guide pulleys 63 within the bracket arm 14 and connected to an indicator element 64 which is slidable along a guide bar 65 behind a display panel 66 on the front of the bracket arm 14. The display panel 66 carries a series of representations 70 depicting the stitch patterns provided by the pattern cams in the cam stack 36 and selectable by operator influence of the knob 60. Beneath each stitch pattern representation 70 is an aperture 75 through the display panel 66.

Figure 3:
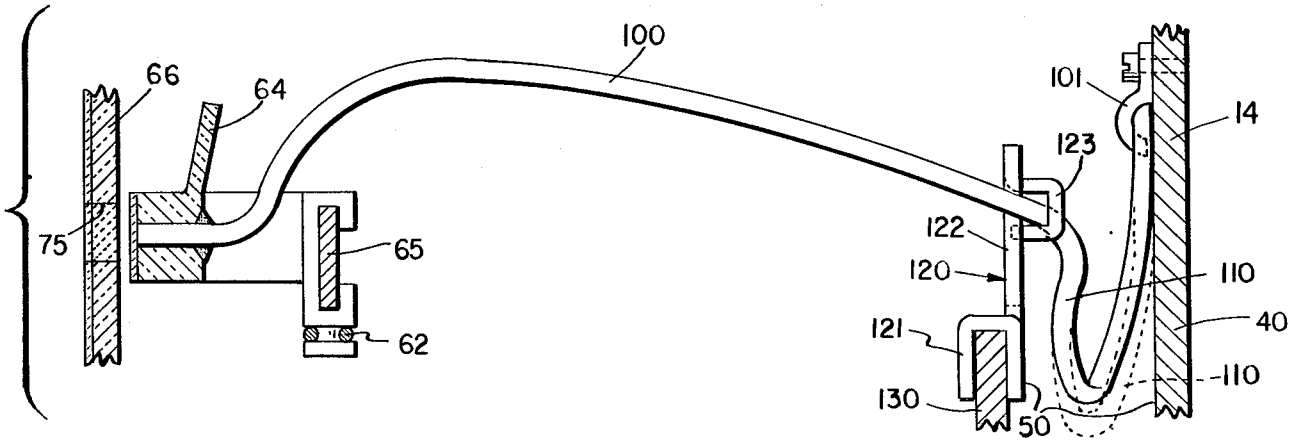
FIG. 3 is an enlarged cross sectional view of selected elements taken substantially along line 3—3 of FIG. 2 showing the movable and fixed extremities of the light pipe and the means for locating and controlling the expandable coil therein.

As best shown in FIGS. 2 and 3, a flexible light pipe 100 is provided anchored at one extremity as by a support bracket 101 adjacent to and facing the lamp 30 in the sewing head so as to pick up illumination into the light pipe 100 from the lamp.

The opposite extremity of the light pipe 100 is secured as shown in FIG. 3 to the indicator element 64 in a position opposite to and in alignment with the apertures 75. With this arrangement light transmitted from the lamp 30 along the light pipe 100 will be directed outwardly through the aperture 75 beneath whichever stitch pattern representation 70 is then selected by turning of the knob 60. In place of the apertures 75 the display panel may be provided with lenses, transparent areas, or any other isolated light conducting areas.

From the lamp 30 to the compartment 50 the light pipe 100 is not required to partake of any movement incident to machine operation or pattern selection and, therefore, the light pipe 100 in this segment may be fixedly secured within the hollow machine frame as by any desired number of support brackets 101 safely out of the way of any mechanism. The opposite extremity of the light pipe 100, however, as it extends from the movable indicator element 64 cannot be so fixedly secured.

To provide for the varying extent of the light pipe 100 as the indicator element 64 is moved along the series of stitch pattern representations 70, means are provided to constrain a portion of the light pipe in an expandable coil or bight 110 within the compartment 50 in which there is no mechanism with moving parts.

Figure 4:
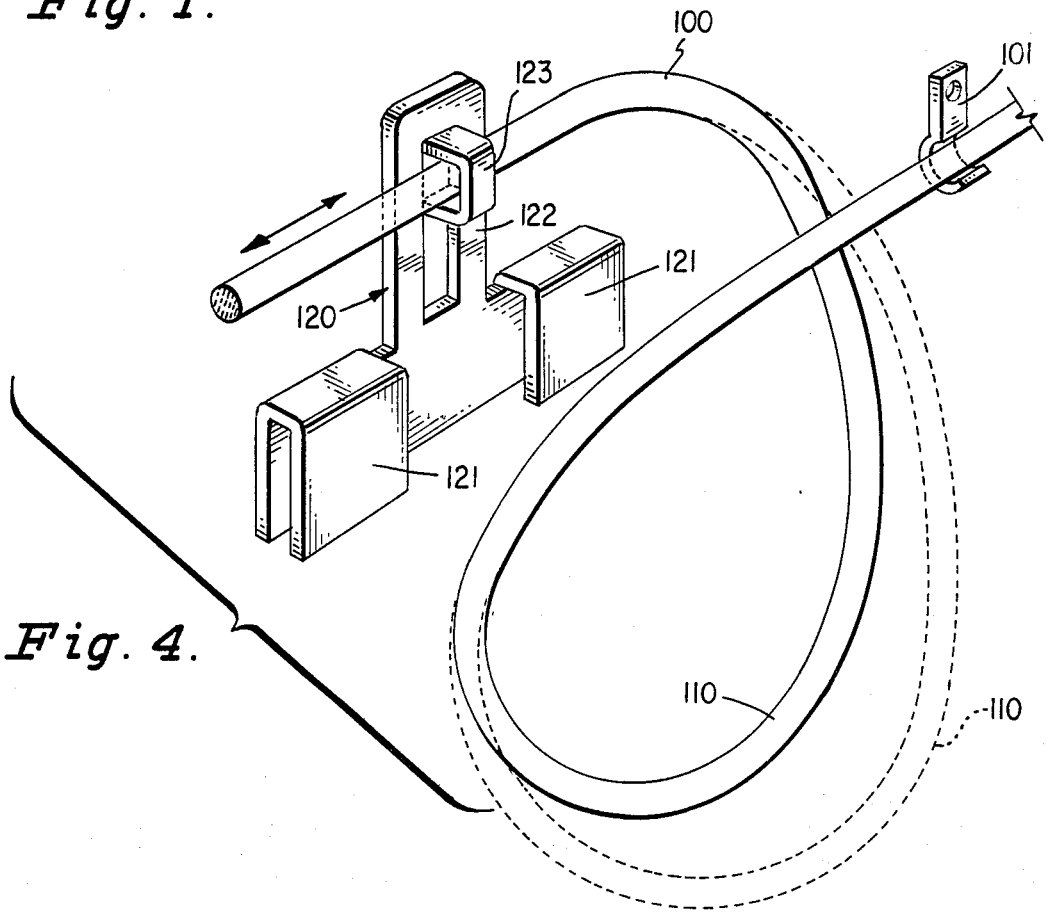
FIG. 4 is a perspective view of the guide element for the light pipe showing the manner in which the guide element eyelet controls the position of the expandable light pipe coil.

For this purpose, a guide element 120 is provided, preferrably having the form illustrated in detail in FIG. 4 including spaced slotted support clips 121 adapted to be forced onto the sheet metal rear plate 130 of the cam stack sub-assembly as shown in FIGS. 2 and 3. The guide element 120 also includes an upstanding arm 122 formed with an eyelet 123 slidably accommodating the light pipe 100 and by virtue of which the expandable coil or bight 110 in the light pipe is formed and constrained in the compartment 50.

It will be appreciated that the eyelet 120 may slidably accommodate both limbs of the light pipe which limbs form the expandable coil or bight and that a compartment free of mechanism for the light pipe coil may be provided by a wide variety of constructions. Where a sub-assembled cam stack is employed, the compartment provided as shown in the accompanying preferred embodiment is particularly cost effective.

We claim:

1. In a sewing machine having a hollow frame, stitch forming instrumentalities supported in said frame, lamp means on said frame arranged to illuminate an area thereon in which stitches are formed, drive mechanism in said frame for said stitch forming instrumentalities, stitch patterning mechanism in said frame for controlling the operation of said stitch forming instrumentalities to produce any one of a plurality of stitch patterns, operator influenced means on said frame for selectively adjusting said stitch patterning mechanism to dictate any selected one of said plurality of stitch patterns, a display panel on said frame including a series of representations each indicative of one of said plurality of stitch patterns, an indicator element shiftably supported on said frame adjacent said display panel, means driven by said operator influenced stitch pattern selector means for shifting said indicator element into registry with the display panel representation of that stitch pattern selected in said stitch patterning mechanism, the improvement which comprises a flexible light pipe arranged within said frame, means for securing one extremity of said light pipe to said frame in a position adjacent to said lamp so as to admit light from said lamp into said light pipe, means for securing the opposite extremity of said light pipe to said indicator element in a position to deliver illumination to an area on said display panel associated with that stitch pattern representation corresponding to the stitch pattern selected by said operator invluenced means.

2. A sewing machine stitch pattern indicating arrangement as set forth in claim 1, means within said frame defining a compartment free of any moving parts, and guide means carried within said frame for engaging and constraining said flexible light pipe in a bight which is located within said compartment and which bight is variable in size as said indicator element is shifted with respect to said display panel.

3. A sewing machine stitch pattern indicating arrangement as set forth in claim 2 in which said stitch patterning mechanism includes a sub-assembly unit comprising a stack of pattern cams journaled between spaced support plates, and in which said sub-assembly unit is secured within said sewing machine frame with one of said support plates arranged in spaced relation to a wall of said sewing machine frame to define said light pipe bight accommodating compartment.

4. A sewing machine stitch pattern indicating arrangement as set forth in claim 3 in which said light pipe guide means comprises a guide element formed with an eyelet loosely accommodating said light pipe, and means for securing said guide element to said compartment defining support plate of said stitch pattern mechanism sub-assembly.

5. A sewing machine stitch pattern indicating arrangement as set forth in claim 1 in which said display panel is formed adjacent each stitch pattern representation with an isolated light conducting area, and in which said opposite extremity of said light pipe is secured to said indicator element to deliver illumination to the light conducting area of said display panel adjacent that stitch pattern representation corresponding to the stitch pattern selected by said operator influenced means.

* * * * *